US005930851A

United States Patent [19]

Brunelle

[11] Patent Number: 5,930,851

[45] Date of Patent: Aug. 3, 1999

[54] HYDRO-THERMO MASSAGING TUB AND METHOD OF TREATMENT

[75] Inventor: Henry Brunelle, Quebec, Canada

[73] Assignee: Bains Ultra Inc., Bernieres, Quebec, Canada

[21] Appl. No.: 08/834,846

[22] Filed: Apr. 10, 1997

[51] Int. Cl.[6] ..... A47K 3/00

[52] U.S. Cl. ..... 4/541.1; 4/541.5; 4/545

[58] Field of Search ..... 4/541.5, 541.1, 4/542.2, 541.4, 545, 546

[56] References Cited

U.S. PATENT DOCUMENTS

| | | | |
|---|---|---|---|
| 3,251,071 | 5/1966 | Wood | 4/541.5 |
| 3,772,714 | 11/1973 | Sealby et al. | 4/541.5 |
| 4,249,522 | 2/1981 | Carrier | 4/541.5 |
| 4,839,930 | 6/1989 | Watkins | 4/541.1 |
| 4,945,908 | 8/1990 | Schneider | 4/546 |
| 4,953,240 | 9/1990 | Gardenier | 4/541.4 |
| 5,012,536 | 5/1991 | Rivera | 4/617 |
| 5,207,499 | 5/1993 | Vajda et al. | 4/541.3 |

*Primary Examiner*—David J. Walczak

*Attorney, Agent, or Firm*—Swabey, Ogilvy, and Renault; Guy Houle

[57] ABSTRACT

A hydro-thermo massaging tub and method of massage treatment wherein the treatment is performed by warm air jets distributed adjacent the bottom wall of the tub all about its circumference. Air jets are formed by holes made in the tub wall with the longitudinal axis of the holes oriented less than 45° from the plane of the bottom wall. The jets communicate with an air distribution duct which is fed hot air under pressure by a blower. Controls are also provided to vary the pressure of the air as well as the temperature thereof. Warm air jets are released in the water contained within the tub to impart turbulence in the body of water to create acupressure massaging flows of warm air jets and water flows from opposed sidewalls and end walls of the tub towards a central area of least turbulence which is occupied by the body of a person. The acupressure massaging flows perform a massaging action all about the body simultaneously. The tub also includes a back massaging cavity to simultaneously massage the back. Hot air circulating in the distribution duct also heats the neck and back portion of the tub where the neck and back of the bather rests during treatment.

21 Claims, 4 Drawing Sheets

HYDRO-THERMO MASSAGING TUB AND METHOD OF TREATMENT

TECHNICAL FIELD

The present invention relates to a hydro-thermo massaging tub and method of operation and wherein a plurality of air jets are formed about the side walls and end walls of the tub to provide acupressure massaging flows comprised of warm air jets and water about the body of a person occupying the tub and simultaneously providing a back massage action while providing heat to the back and neck portion of the bather and wherein the air pressure as well as the temperature of the air is controllable by the bather or an attendant.

BACKGROUND ART

In an earlier patent assigned to the assignee of the present invention, namely U.S. Pat. No. 4,249,522 issued Feb. 10, 1981, there is disclosed the construction of a hydro massage bathtub for domestic and therapeutic applications. In that patent, air jets are formed in the sidewall and end walls of the bathtub and a cavity is provided in a backrest portion of the tub to provide a massage to the bather's back. Such a massage bathtub has been found advantageous over other forms of massaging bathtubs where water and air is released through nozzles contained at strategic locations in the sidewalls or bottom wall of a bathtub. Other forms of massaging bathtubs where air only is released within the tub are known and again the air is released through nozzles usually mounted in the bottom wall of the tub. The problem with such massaging tub construction is that the treatment by water massage is not uniform over the body of a bather sitting in the bathtub and causes skin and muscular irritation in localized areas of the body due to the pressure of the water displaced by the jets and the proximity of the jet nozzles to the body of the bather sitting in the tub. Another disadvantage is that the air is not heated and when released in a hot tub it causes discomfort and could also cause muscle contraction and spasm.

Today people are more sensitive to their well-being and therefore pay more attention to their health due to this awareness of its importance on their quality of life. They are determined to maintain and enhance their physical condition and are seeking simple, efficient and personalized solutions to meet their health objectives. There is therefore a need to provide a hydro massaging bathtub which can meet these objectives and wherein natural products can be added to the water contained within the tub.

SUMMARY OF INVENTION

It is an object of the present invention to provide a hydro-thermo massaging tub wherein the air before being released within the tub in the form of air jets is heated so that the warm air jets entering the bathtub will impart a displacement of the water to create massaging flows of warm air jets and warm water and wherein these massaging flows are disposed all about the bather occupying the bathtub at strategic locations.

Another feature of the present invention is to provide a hydro-thermo massaging tub wherein the pressure of the massaging jets as well as the temperature of the air bubbles is controllable by the bather or an attendant and wherein the tub is provided with a headrest and backrest which is heated by an internal warm air flow within the distribution duct to heat the neck and back portion of the bather while undergoing a massage thereby closely simulating a real massage treatment but all over the body, simultaneously, as compared to treatments received by a masseur therapist.

Another feature of the present invention is to incorporate within the bathtub a lamp having interchangeable colored lenses to impart different light frequencies in the water turbulence to produce different physical effects to a bather undergoing the hydro-thermo massage.

Another feature of the present invention is to provide a hydro-thermo massaging tub wherein the tub walls can be heated by external electric heating conductors attached to the bathtub walls.

Another feature of the present invention is to provide a hydro-thermo massaging tub which is highly hygienic and which permits the use of additives in the water which are completely expelled from the tub after use.

Another feature of the present invention is to provide a hydro-thermo massaging tub wherein the distribution of the air jets permits the bather to move freely and adopt comfortable positions within the tub while being subjected to the massaging action of the hydro-thermo massage flows.

Another feature of the present invention is to provide a hydro-thermo massaging tub which is totally safe and usable by most people, without any medical or health restrictions even when used on a daily basis.

Another feature of the present invention is to provide a novel method of hydro-thermo massage in a bathtub having an open-top-end treatment chamber.

According to the above features of the present invention there is provided a hydro-thermo massaging tub which comprises an enclosure having a bottom wall, opposed sidewalls, opposed end walls and an open-top-end. An air distribution duct is associated with at least the sidewalls and end walls. A plurality of holes of predetermined dimension are disposed in the sidewalls and end walls and at predetermined spacing all around the tub and communicate the air distribution duct with an inner chamber of the tub. The holes are disposed above the bottom wall and have their longitudinal axis oriented less than 45° from the plane of the bottom wall. An air blower is connected to the air distribution duct for directing air under pressure in the duct. Control means are provided to control the pressure of the air and heater means are provided for heating the air under pressure. Means are also provided to control the temperature of the air under pressure which is released through the plurality of holes as warm air jets in the body of water contained within the inner chamber. The warm air jets impart turbulence in the body of water to create acupressure massaging flows of warm air jets and water from opposed sidewalls and end walls towards a central area of least turbulence in the inner chamber. When a bather's body occupies the area of least turbulence, the massaging flows will perform a massaging action on the body about the area of least turbulence with the massaging flows increasing in turbulence due to an obstruction of the area of least turbulence by the occupying body. Means are provided to drain water from the inner chamber after use.

According to a further broad aspect, heating means are provided to heat a portion of one of the end walls to heat at least the neck of the bather while undergoing the hydro-thermo massage.

According to a further broad aspect of the present invention there is provided a method of hydro-thermo massage which comprises the steps of providing an open-top-ended tub having a plurality of air jets disposed about opposed sidewalls and end walls of an inner chamber of the tub and spaced above a bottom wall thereof and oriented whereby an air stream flows from the jets at an angle above 45° from the plane of the bottom wall. The tub is filled with a predetermined quantity of water and air under pressure is applied in a distribution duct which communicates with the jets. The air under pressure is heated and the bather or an attendant controls the pressure of the air and the temperature thereof to create a controlled turbulence in the water which consists of a plurality of hydro-thermo massage flows of warm air jets and water directed from the opposed sidewalls and end walls of the tub and towards a central area of least turbulence in the inner chamber. The bather positions his body in the area of least turbulence whereby the hydro-thermo massage flows will perform a massaging action about the body.

BRIEF DESCRIPTION OF DRAWINGS

A preferred embodiment of the present invention will now be described with reference to the accompanying drawings in which.

DESCRIPTION OF PREFERRED EMBODIMENTS

The hydro-thermo massaging tub of the present invention performs a combination of three techniques namely thermo therapy, hydro therapy and massage therapy. Thermo therapy and hydro therapy use heat and water, respectively, to clean and free pores thus allowing the body to eliminate toxins. Once this waste has been expelled, the skin can capture, filter, and by a process known as osmosis, absorb vital minerals, trace elements and other nutrients required by the body. On the other hand, massage therapy consists of therapeutic manipulations, such as tapping, stroking, rubbing, pounding, kneading, pinching, pressing, patting, vibrating, etc., which is applied to the body by the hands of a massage therapist, or by any other method. These manipulations speed up internal body processes thus allowing the system to cleanse itself. They invigorate and rehabilitate the body for optimum functioning.

With the hydro-thermo massaging tub of the present invention the bather's body when immersed into the water, which is usually hot, as contained within the tub he is exposed to a heat-activated, massaging effect of moving water to which therapeutic products may have been added. By varying the intensity of the air flow through the jets the air pressure and water circulation is varied and causes the bath to bubble. The combined action of heat and hydromechanical activity provides not only superficial effects, but in-depth, therapeutic benefits for the whole body, through a chain of specific chemical, physical and physiological reactions. The benefits thus obtained with such hydro-thermo massage are comparable to those obtained from a full therapeutic massage. The advantage of the hydro-thermo massage over hand massage is that it works simultaneously on all parts of the body thus providing the desired results in a much shorter period, from about 20 to 30 minutes. In short, hydro-thermo massage is an efficient, harmless and gentle way for a person to reach his goals of in-depth relaxation, muscular and joint energizing and therapeutic massage.

Figure 1:
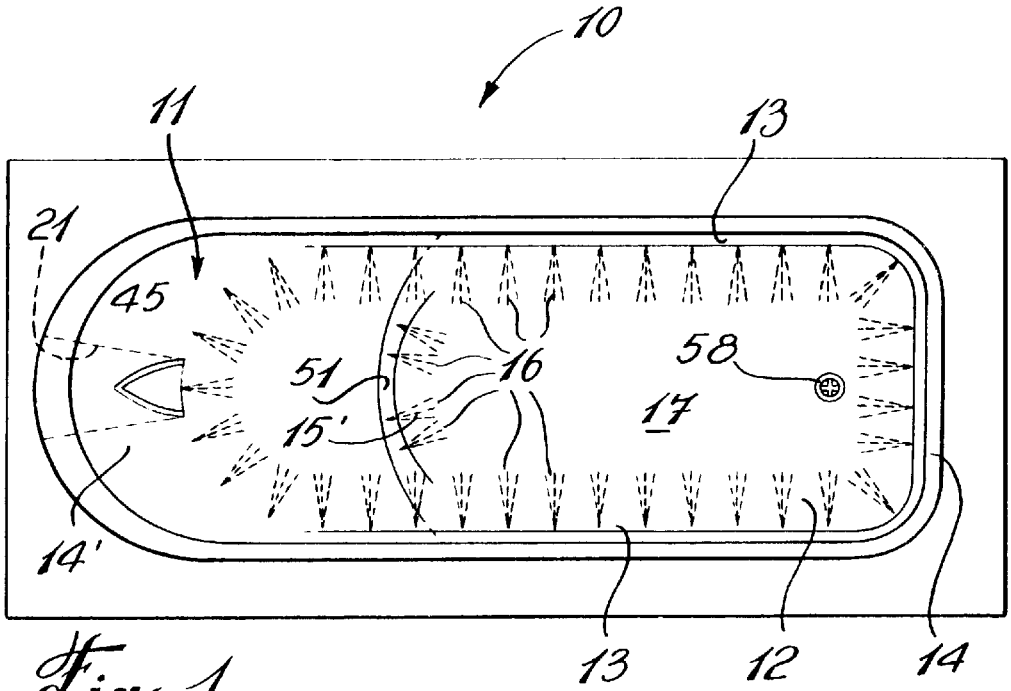
FIG. 1 is a top view of the hydro-thermo massaging tub of the present invention illustrating the distribution of the massaging jets.
Figure 2:
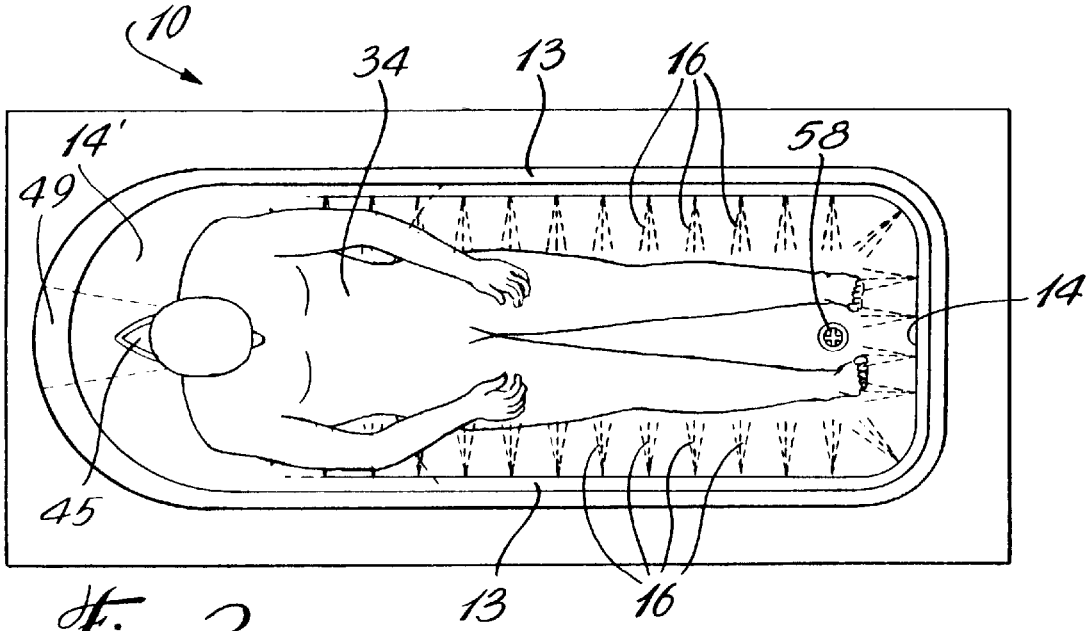
FIG. 2 is a top view similar to FIG. 1 but showing the body of a person positioned in a central area of the tub with the massaging jets performing a hydro-thermo massage all about the bather's body.
Figure 3:
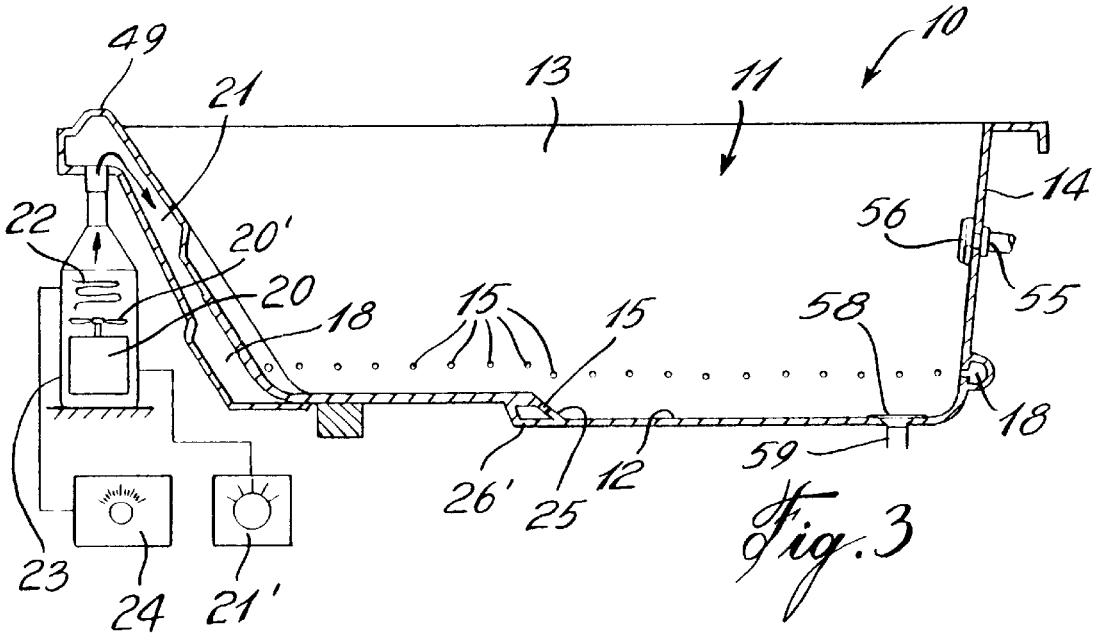
FIG. 3 is a longitudinal section view of the hydro-thermo massaging tub of the present invention partly illustrating in schematic the blower/air and controls therefor.

With reference now to FIGS. 1 to 3, there is shown generally at 10 the hydro-thermo massaging tub of the present invention. It consists of an open-top-end enclosure 11 herein referred to as a tub and formed by a molded structure defining a bottom wall 12, opposed side walls 13 and opposed end walls 14 and 14'. In the embodiment of the tub structure as shown in FIG. 1, end wall 14 is the foot end of the tub whereas end wall 14' constitutes the head end of the tub. Of course with a double occupant tub there would be a head end at opposed ends of the tub.

The side walls 13 and end walls 14 and 14' of the tub are provided with a plurality of holes 15 of predetermined size, spacing and orientation all about the tub and these constitute air jets 16 which create acupressure massaging flows of warm air jets in hot water, from opposed sidewalls and end walls, which radiate towards a central area 17 of the tub and as herein shown which is an area of least turbulence in the inner chamber of the tub. These holes 15 communicate with an air distribution duct 18 which is secured to the outer wall surface 19 of the tub, as will be described later.

A turbine air blower 20 is connected to a header chamber 21 of the air distribution duct 18 in order to convey air under pressure into the air distribution duct and out of the air jet holes 15. A turbine speed control or pressure control 21 controls the speed of the turbine 20' of the turbine air blower 20 to increase or decrease the pressure of the massaging flows of the air jets 16. As herein shown a resistive heating element 22 is positioned within the air blower housing 23 to warm the air being fed to the air distribution duct 18. A temperature control 24 varies the current flowing through the resistive heating element 22 and therefore the temperature of the air being conveyed to the air distribution duct.

Figure 4:
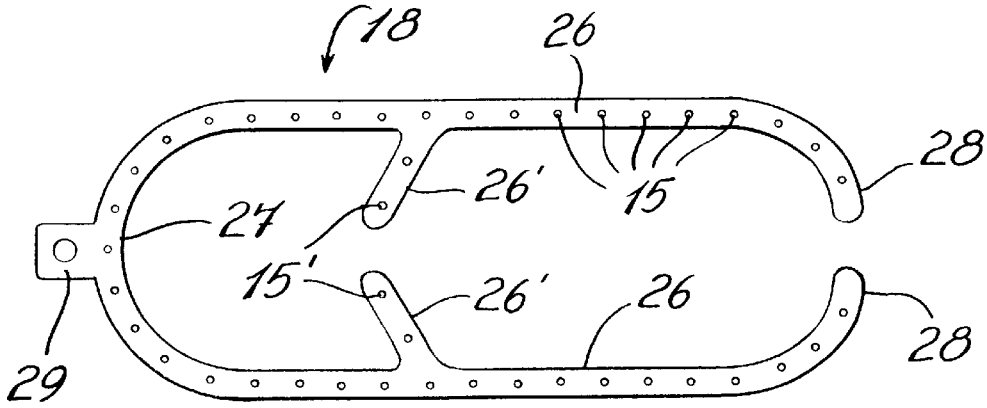
FIG. 4 is a plan view illustrating the configuration of the air distribution duct about the tub.
Figure 5:
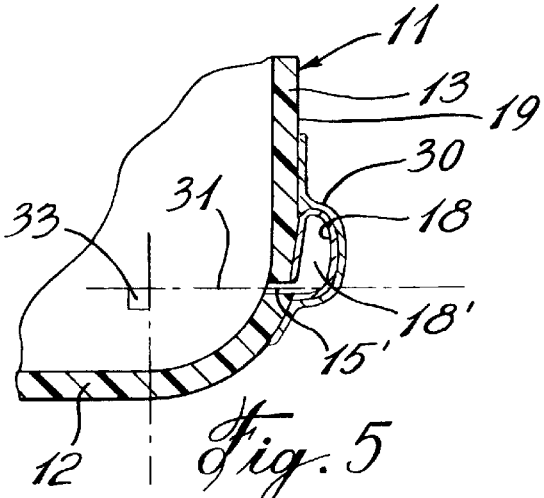
FIG. 5 is an enlarged cross-section view showing the position of one of the jet holes relative to the air distribution duct and the manner in which the duct is attached to the side wall of the tub.
Figure 6:
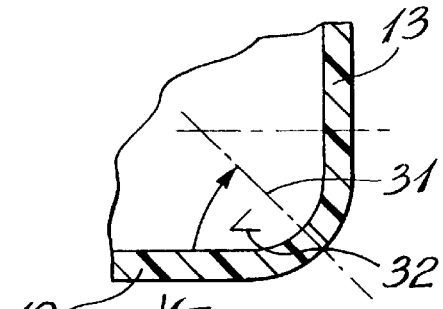
FIG. 6 is a fragmented section view of a bottom corner of the hydro-thermo massaging tub illustrating the preferred range positions of the air jets.

With reference now to FIGS. 4 to 6 there will be described the manner in which the air distribution duct 18 is constructed as well as the holes 15 which constitute the air jets.

The air distribution duct 18 is shaped to be secured to the outer surface of the side walls, end walls and a transverse ridge wall 25 formed in the bottom wall of the tub. The air distribution duct is thus shaped for close fit with the outer surface 19 of the tub in the area where it is to be secured. Accordingly, the air distribution duct defines opposed side arms 26, an interconnecting head branch 27 and a pair of opposed end arms 28 which will be secured to the foot end wall 14. A header connection 29 will form the header chamber 21.

As shown in FIG. 5, the air distribution duct 18 is secured to the outer wall surface 19 by one or more layers of fiberglass material 30 to integrate the duct 18 with the side wall and to prevent air leakage. The duct is precisely positioned whereby the holes 15 will communicate with the inner chamber 18' of the duct. At least some of the holes, such as hole 15', are formed at the base of the inner chamber 18' to expel any foreign material or water that may seep through the hole 15 during the filling cycle of the tub or after the use of the tub and drainage. During filling, the water is expelled by the air blower when switching on to activate the water jets.

It is very important to note that in order to achieve proper hydro-thermo massaging that the jets or holes 15 be formed with their longitudinal axis 31 extending at an angle of less than 45° from the plane of the bottom wall 12, as illustrated by angle 32 in FIG. 6, and preferably at an angle of about 90° from the side wall 13 which is parallel to the bottom wall (0°), as illustrated at 33 in FIG. 5. This orients the warm air jets and causes the water and air jet massaging flows to be directed all about the bather's body, as illustrated in FIG. 2. As shown in FIG. 2, the bather's body 34, when sitting or lying within the tub, occupies the central area 17 of the tub where there is least turbulence. By occupying the space the outer periphery of the body 34 is in contact with the air jets 16 all about the body and therefore the bather obtains a full hydro-thermo massage.

Figure 7:
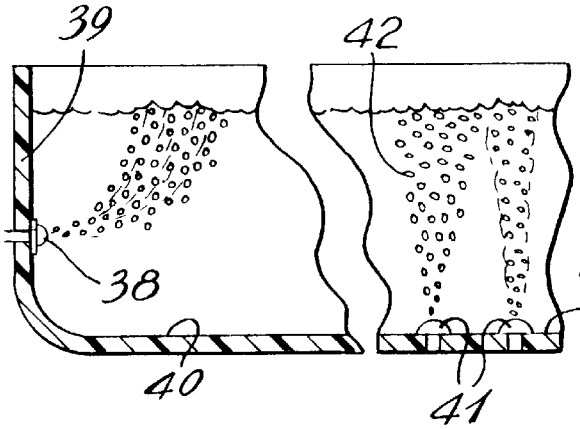
Fig. 7 (PRIOR ART)
FIG. 7 is a fragmented schematic section view showing hydro-massaging systems of the prior art.
Figure 8:
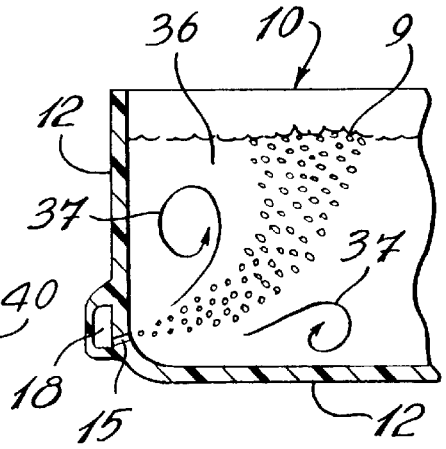
FIG. 8 is a fragmented schematic section view of the hydro-thermo massage flows of the present invention.

FIG. 8 illustrates the action of the hot air jets 16 and water turbulence. As herein shown because of the orientation of the jet, the air jets will create a flow which is propulsed close to the bottom wall 12 and then expands to the water surface 9 of the water 36 within the tub to cause turbulence on the water surface 9. As the air exits the jets 16 it causes the water to be displaced in opposed directions as indicated by arrows 37 resulting in a massaging action on the body portion of the bather occupying the tub. As can be seen in FIG. 7, with the prior art, there are basically two types of massaging bathtubs. As herein shown, in one type water and air is mixed and released through valves 38 which are secured to the side wall 39 of the tub and spaced upwardly from its bottom wall 40. This merely causes a lot of activity in the top surface of the water and provides localized massage to any body part which is in contact with the adjustable valve or fitting 38. This localized massage action has been known to cause irritation of the skin and muscle in contact therewith. Another disadvantage of such tubs is that they are not sanitary as any product which is placed into the water will circulate in the convection conduits and stagnate to eventually create bacteria which may be passed on to other bathers. FIG. 7 also shows an embodiment wherein air valves 41 are secured to the bottom wall 40 of the tub and release air which forms air bubbles 42 into the water. Again, a disadvantage is that the air valves 41 are used and water will again be accumulated in the valves and/or the convection channel secured to the bottom wall of the tub. Furthermore, these air bubbles rise from the bottom of the tub and are not strategically oriented to provide a total massage of the body of the bather. The air is also not warmed before being released into the tub which is necessary to achieve the desired massaging results of thermo massage.

Figure 9:
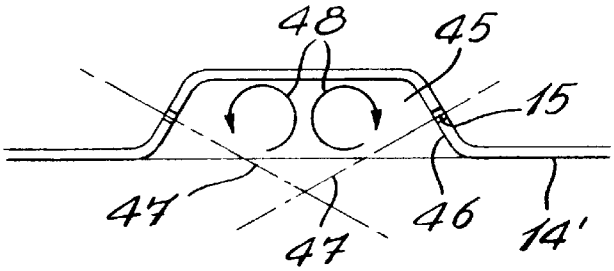
FIG. 9 is a schematic top section view showing the massaging action of the air jets and water flow in a back massaging cavity of the tub.
Figure 10:
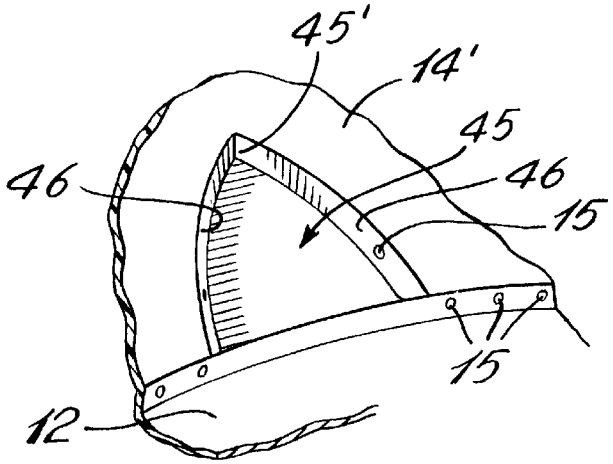
FIG. 10 is a fragmented perspective view showing the configuration of the triangular shaped back massaging cavity of the tub and the position of the jets.
Figure 11:
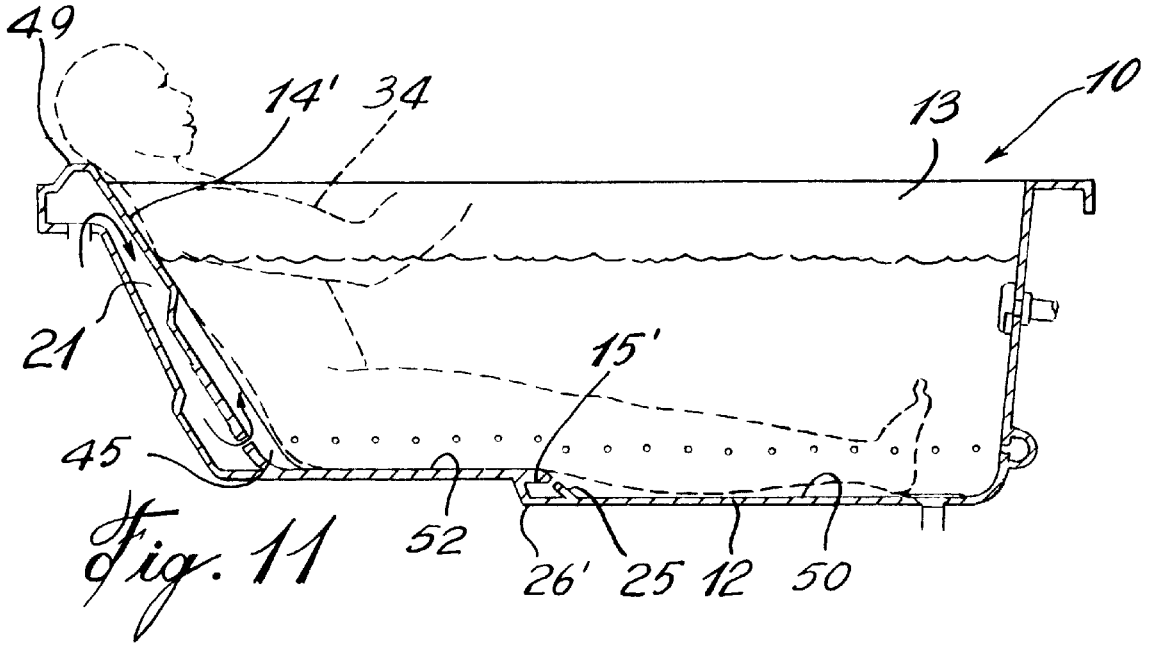
FIG. 11 is a section view showing the warm air flow against the end wall of the tub in the back area of an occupant lying against the end wall.

Referring now additionally to FIGS. 10 and 11, as well as FIGS. 1 to 3, it can be seen that the head end 14' of the tub or enclosure is provided with a back massaging cavity 45 which extends from the bottom wall 12, as better seen in FIG. 10, and tapers upwardly along the end wall 14'. The back massaging cavity 45 is also provided with opposed side wall surfaces 46 in at least a lower portion of the cavity. At least one hole 15 or air jet is formed in a lower portion of each of the opposed side wall surfaces 46 and oriented at 90° to the side wall surface 46 which is parallel to the bottom wall, 0° thereto. As shown in FIG. 9, the side wall surface 46 is sloped outwardly. The longitudinal axes 47 of these jets 15 cause the water to be displaced in opposite directions, as indicated by arrows 48, within the cavity 45 causing a turbulence which rises up the cavity towards the upper end thereof and thereby providing a massaging function along the back in the spinal cord region of the bather 34 from the bottom to the top as required in hand massage therapy. The cavity 45 has a substantially elongated triangular shape and the apex 45' thereof merges smoothly within the end wall 14' and terminates below the neck and headrest 49 provided at the upper end of the head end 14' of the tub to also massage the neck.

As previously described the air distribution duct is provided with a header chamber 21 and as shown in FIG. 11, this header chamber is in contact with the headrest 49 and the upper portion of the end wall 14' whereby to warm the tub in the area of the heater chamber 21 as defined in FIG. 1. This provides heat to the back of the neck and upper back of the bather 34 occupying the tub which is important in massage therapy to provide for better blood circulation and relaxation.

As also shown in FIGS. 1, 3 and 11, the bottom wall 12 of the tub is provided with a central depression 50 and a convexly curved transverse ridge wall 25 delineates this depression and provides an end seat portion 52 in the tub. As shown in FIG. 4, the air convection duct is provided with opposed converging branches 26' which extend behind the transverse ridge wall 25 to communicate with the air ducts 15' formed in the ridge wall at predetermined locations with their longitudinal axis again oriented less than 45° from the plane of the bottom wall 12. This provides a further leg massage or lower back massage action to the bather 34 and to certain muscles depending on the seated position of the bather 34 within the tub whether seated above the jets 15' or in front of these jets.

As shown in FIG. 3, a sealed light enclosure 55 may be secured to the end wall 14 or other convenient location of the tub 10 and oriented to face the bather 34 and disposed to be immersed within the body of water in the tub. The sealed light enclosure has a detachable lens cover 56 permitting lenses of different colors to be interchanged. The different color lenses impart different light frequencies in the water turbulence and produce different physical effects to the bather's body, as is well known. This adds to the overall well-being of the bather undergoing massage therapy.

Figure 12A:
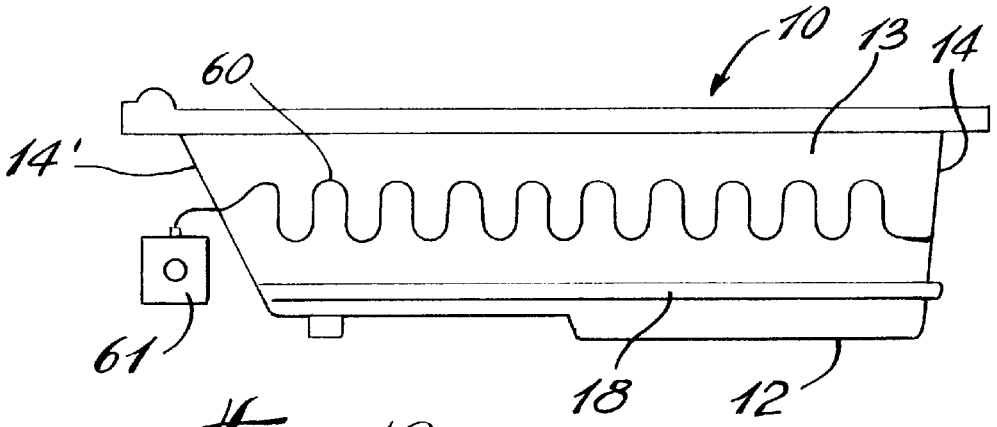
FIGS. 12A and 12B are schematic side and end views showing a heating cable secured to the outer surface of the tub walls to heat the walls to regulate the temperature of the water within the tub during use when the turbulence in the water has a tendency of cooling the water within the tub.
Figure 12B:
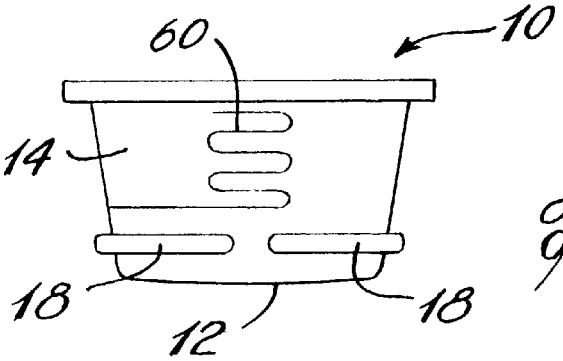

FIGS. 12A and 12B show a heating cable 60 being secured to the sidewalls 13 and at least the foot end wall 14 of the tub to heat the tub walls to compensate for heat loss of the water in the tub due to the turbulent action of the water as the warm air from the jets is not sufficient to stabilize the water temperature. The heating wires or cables 60 are constructed such as to produce non-harmful electric fields to the bather. A cable may also be secured to the air ducts to provide more heat to the air. A control 61 may also be provided to regulate the current flow through the cable 60 and consequently the heating capacity thereof. This heating cable may also be connected simultaneously when the power of the air blower is turned ON and disconnected when it is turned OFF.

As previously described the air blower may also be programmed to go through a drain cycle when the tub is being emptied through the drain hole 59 formed in a lower portion of the bottom wall 12. A drain hole cover 58 is provided to obstruct the drain hole 59. The cycling of the air blower may also be activated by the position of the mechanism (not shown) which actuates the cover 58 to open the drain hole.

Summarizing the method of use of the hydro-thermo massage tub of the present invention, the tub is firstly filled with a predetermined quantity of hot water and the bather then immerses himself in the tub seated at a convenient position, as shown in FIG. 2, where it occupies a central area of the tub. The air blower and heating element are then turned on, if it has not already been turned ON before the bather enters the tub and air under pressure is thereby released within the water forming hydro-thermo acupressure massage flows which perform a massaging action all about the body of the bather, as better seen from FIG. 1. Simultaneously, the back cavity 45 massages the back of the bather all along the spinal area while the outer chamber of the air convection duct warms the bather's neck area and upper back portion. Simultaneously the jet in the curve ridge wall 25 provides a massaging action to the back of the legs. If the sealed light enclosure 55 is provided then the light frequency in the water turbulence provides another physical effect to the bather's body. Nutrient may also be added to the water for other beneficial effects.

The hydro-thermo massage provided by the present invention gives the body four different types of massages which are consecutive and complimentary and namely relaxation, muscular and joint energizing and together with the first three massages combined with other water product enhancers, a therapeutic massage. Various types of product enhancers can be used and are so numerous that they will not be mentioned herein but consist of essential oils, or mud and a large class of medical plants which relieves all sorts of medical and physical disorders.

Relaxation massage loosens tense muscles, eliminates cramps, soothes the nervous system and relaxes mind and body—the keys to overall well-being and the ability to enjoy deep, recuperative sleep.

The bath provides a synergy of massage-therapy principles. The hot air injected into the water stimulates the bather's epidermis, providing a "mini workout" for the skin and an acupressure treatment (a type of acupuncture using pressure) for the entire body. This epidermal workout actively cleanses the pores and works on the nerves and the capillaries in the derma (the layer of skin just under the epidermis). Massaging of the nerves, capillaries and lymphatic system facilitates relaxation of the peripheral nervous system. The brain is signalled to release and stop producing adrenaline, a hormone that stimulates the system. Gradually, after seven or eight minutes of continuous massage, the whole body enters a relaxed state.

The next step begins eight to twelve minutes into the massage. External heat penetrates the bather's body, working on the epidermis, opening pores, liquefying fat and sebum, and cleansing and loosening the skin. This allows the body to rid itself of accumulated toxins, free radicals and micro-waste, which are carried by the lymphatic and circulatory systems to the pores, where they are expelled from the organism. This process of eliminating pollutants allows the internal organs and system to function better and work more effectively.

The relaxation massage is followed by a muscular and joint massage after twelve to seventeen minutes. The heat continues to penetrate the epidermis and derma. It further liquefies the lymph, which begins to circulate faster, and warms muscles and nerves deep inside the body. As internal body heat rises, cells dilate, blood circulation improves therefore releasing the fatty liquids that retain the different residues and waste. The lymph which circulates in the muscles and joints, then drains this waste in a body purification process. This cleansing process will relax tense and aching muscles and joints.

From the 17th to the 25th minutes, an invigorating massage takes place that leads to the energizing massage. The skin, already cleansed, is now ready to attract and, through osmosis, to absorb the nutrients and active substances contained in the water, to the lymphatic and blood system. The bath of the present invention can bring about a sevenfold acceleration in the flux of interstitial lymph, which carries red and white blood cells and nutrients (enzymes and co-enzymes, minerals, hormones and other vital substances). The lymph redistributes these nutrients throughout the whole body, especially to vital organs where the need is greatest. The nourishment helps improve performance. In return, toxins and other waste that the body has accumulated and needs to eliminate to remain healthy are carried by the lymph to the filtering and eliminative organs (kidneys, lungs, intestines and skin). The liver, pancreas and kidneys do a much better job of filtering and purifying after they have been cleansed.

To heighten the therapeutic effect of the hydro-thermo massage, a wide variety of products, with therapeutic properties, may be added to the water. The bath has been designed for unlimited use with therapeutic ingredients, without any risk to the mechanism or to safety.

A wide range of substances is available, including kelp, essential oils, a mineral-rich volcanic or marine mud. When these ingredients are added to the water, their active agents are absorbed through the skin by osmosis. They immediately enter the lymphatic system, which delivers them quickly to the internal organs and systems, where they are processed into easily assimilated nutrients.

Summarizing, during the first 20 to 30 minutes in the bath, the bather's body will undergo a series of physical and psychological reactions. Initially, he will begin to feel a reduction in stress, following which his body will feel released and more flexible. After a while, he will feel the effects deep in his joints and muscles.

The nervous system, circulatory system and joints are cleansed as accumulated toxins and unwanted mineral deposits are dissolved. Hydro-thermo massage helps re-stabilize the muscular system and joints, as well as internal filtration systems (such as the liver, kidneys, pancreas and lungs). It also increases and eases the absorption of vital and energy-rich nutrients.

The hydro-thermo massage helps prevent a wide variety of health problems caused by poor lymph or blood circulation, which lead to the build-up of toxins and deposits within the body.

Although hydro-thermo massage is not intended to replace treatments by professional therapists, regular hydromechanical massage baths constitute a highly effective, complementary therapy.

It is within the ambit of the present invention to cover any obvious modifications of the preferred embodiment described herein, provided such modifications fall within the scope of the appended claims.

I claim:

1. A hydro-thermo massaging tub comprising an open-top-end enclosure having a bottom wall, opposed sidewalls, and opposed end walls; an air distribution duct associated with at least said sidewalls and end walls, a plurality of holes of predetermined dimension disposed in said sidewalls and end walls and at predetermined spacing all around said tub and communicating said air distribution duct with an inner chamber defined by said tub, said holes forming air jets, said holes being disposed above said bottom wall and having their longitudinal axis oriented at an angle less than 45° from the plane of said bottom wall, an air blower connected to said air distribution duct for directing air under pressure in said duct, control means to control the pressure of said air, heater means for heating said air under pressure, means to control the temperature of said air under pressure, said air under pressure being released through said plurality of holes as warm air bubbles in a body of water contained within said inner chamber, said warm air jets imparting turbulence in said body of water to create acupressure massaging flows of warm air jets and water from opposed sidewalls and end walls towards a central area of least turbulence in said inner chamber such that when a bather occupies said area of least turbulence, said massaging flows will perform a hydro-thermo massaging action simultaneously about the bather's body, means to drain water from said inner chamber; and a sealed light enclosure secured to one of said end walls of said tub for facing a bather in said tub and positioned to be immersed in said water, said light enclosure having a detachable lens cover, said detachable lens cover being adapted to interchange lenses of different colors to impart different light frequencies in said water turbulence to produce different physical effects to said bather.

2. A hydro-thermo massaging tub as claimed in claim 1 wherein there is further provided means to heat said tub in a neck support area thereof.

3. A hydro-thermo massaging tub as claimed in claim 2 wherein at least one of said end walls is provided with said means to heat said tub and is formed with a back massaging cavity extending from said bottom wall and tapering upwardly along said end wall to terminate in an upper area of said end wall, said back massaging cavity having opposed sidewall surfaces in at least a lower portion thereof, at least one of said holes being located in each said sidewall surface whereby when a bather's body occupies said area of least turbulence, said massaging flows generated by said holes in said sidewall surfaces will cause a massaging turbulence flow guided upwardly by said back massaging cavity towards said neck support area.

4. A hydro-thermo massaging tub as claimed in claim 3 wherein said back massaging cavity is a substantially triangular shaped cavity, said sidewall surfaces being outwardly inclined surfaces merging into an outer surface of said at least one end wall at an apex end of said cavity.

5. A hydro-thermo massaging tub as claimed in claim 3 wherein said back massaging cavity terminates below said neck support area in an upper portion of said at least one end wall.

6. A hydro-thermo massaging tub as claimed in claim 5 wherein said means to heat said tub is constituted by said air distribution duct having a header chamber associated with said at least one end wall to heat said end wall and said neck support area with said heated air under pressure to heat the neck and back area of a bather occupying said tub.

7. A hydro-thermo massaging tub as claimed in claim 6 wherein said side wall and end walls are provided with a heater cable to heat same, said cables also being provided on said air distribution duct and header.

8. A hydro-thermo massaging tub as claimed in claim 2 wherein said bottom wall is provided with a central depression which forms at least one transverse convexly curved ridge wall, said air distribution duct has one or more branches communicating with said curved ridge wall, at least two of said holes of predetermined dimension are disposed in said curved ridge wall at predetermined locations and communicating with said one or more branches and disposed with their longitudinal axis oriented less than 45° from said plane of said bottom wall.

9. A hydro-thermo massaging tub as claimed in claim 1 wherein said longitudinal axis of said holes in said sidewalls and end walls are oriented preferably parallel to said bottom wall.

10. A hydro-thermo massaging tub as claimed in claim 1 wherein at least some of said holes are in communication with a lower section of said air distribution duct to evacuate any water or foreign matter that may infiltrate said duct from said inner chamber.

11. A hydro-thermo massaging tub as claimed in claim 1 wherein said control means is a fan speed controller to vary the speed of a fan of said blower to increase or decrease the air pressure in said air distribution conduit to vary the intensity of air pressure of said air jets to produce a controllable hydro-thermo massage capable of working simultaneously on many parts of a bather's body.

12. A hydro-thermo massaging tub as claimed in claim 11 wherein said heater means is a resistive heating coil disposed in an air convection path of a blower housing of said blower, and wherein said means to control the temperature of said air is a variable current control switch to vary the current fed to said resistive element.

13. A hydro-thermo massaging tub as claimed in claim 1 wherein said means to drain water from said inner chamber is a drain hole provided in said bottom wall, and a drain hole cover detachably connected to said drain hole, said blower having a drain cycle to flush any water or foreign matter that may have entered said distribution duct through said holes.

14. A method of hydro-thermo massage comprising the steps of:

i) providing an open-top-ended tub having a plurality of air jets disposed about opposed sidewalls and end walls of an inner chamber of said tub and spaced above a bottom wall thereof and oriented whereby an air stream flows from said jets at an angle less than 45° from the plane of said bottom wall, ii) filling said tub with a predetermined quantity of hot water, iii) applying air under pressure in a air distribution duct in contact with said jets, iv) heating said air under pressure, v) controlling the pressure of said air and the temperature of said air to create a controlled turbulence in said water consisting of a plurality of hydro-thermo acupressure massage flows of warm air jets and water created by said pressurized air emitting from said opposed sidewalls and end walls towards a central area of least turbulence in said inner chamber, vi) positioning a bather's body in aid area of least turbulence whereby said hydro-thermo massage flows will perform a massaging action about said body, vii) simultaneously heating one of said end walls in a neck support area of said tub to warm the neck of said bather, viii) providing a sealed light enclosure in one of said end walls facing a bather occupying said tub and positioned to be immersed in said water, said sealed light enclosure having a detachable lens cover, and ix) interchanging lenses of different colors to impart different light frequencies in said water turbulence to provide different physical effects to said bather.

15. A method as claimed in claim 14 wherein there is further provided the steps of:

(a) providing a back massaging cavity in one of said end walls, (b) creating hydro-thermo massage flows in opposed sidewall surfaces of said cavity in a lower portion thereof to create a massaging turbulence, and (c) guiding said turbulence upwardly along said cavity to massage the back of said bather.

16. A method as claimed in claim 14 wherein there is further provided the step of:

(a) providing a central depression defining at least one transverse convexly curved ridge wall across said opposed sidewalls and providing at least two of said jets in said ridge wall oriented with their air stream flowing therefrom at an angle of less than 45° from the plane of said bottom wall.

17. A method as claimed in claim 14 wherein there is further provided the step of:

(viii) draining said inner chamber after massaging a bather's body, and (ix) evacuating any water or foreign matter from said air distribution duct.

18. A method as claimed in claim 14 wherein said step (vi) includes:

(a) subjecting said bather's body to a relaxing massage during a first cycle of approximately 8 to 12 minutes, (b) subjecting said bather's body to a skin cleansing and loosening cycle by the heat of said water and air jets and a muscular and joint massage during a following second cycle of approximately 5 additional minutes, and (c) subjecting said bather's body to an energizing massage during a following third cycle of approximately 7 additional minutes, whereby to subject said bather's body to physical psychological reactions.

19. A method as claimed in claim 14 wherein there is further provided after step (ii) the step of adding active ingredients to said water to provide active agents to be absorbed by osmosis in the skin of said bather.

20. A hydro-thermo massaging tub comprising an open-top-end enclosure having a bottom wall, opposed sidewalls, and opposed end walls; an air distribution duct associated with at least said sidewalls and end walls, a plurality of holes of predetermined dimension disposed in said sidewalls and end walls and at predetermined spacing all around said tub and communicating said air distribution duct with an inner chamber defined by said tub, said holes forming air jets, said holes being disposed above said bottom wall and having their longitudinal axis oriented at an angle less than 45° from the plane of said bottom wall, an air blower connected to said air distribution duct for directing air under pressure in said duct, control means to control the pressure of said air, heater means for heating said air under pressure, means to control the temperature of said air under pressure, said air under pressure being released through said plurality of holes as warm air bubbles in a body of water contained within said inner chamber, said warm air jets imparting turbulence in said body of water to create acupressure massaging flows of warm air jets and water from opposed sidewalls and end walls towards a central area of least turbulence in said inner chamber such that when a bather occupies said area of least turbulence, said massaging flows will perform a hydro-thermo massaging action simultaneously about the bather's body, means to drain water from said inner chamber, and said sidewall and end walls being provided with heater means to heat portions of said tub, said heater means being associated with said air distribution duct and a header of said enclosure to heat portions of said tub to provide heat to portions of a bather's body in contact therewith.

21. A hydro-thermo massaging tub as claimed in claim 20 wherein the heater means is provided by one of heater cables and hot air.

* * * * *